US005662070A

United States Patent [19]

Kastner et al.

[11] Patent Number: 5,662,070

[45] Date of Patent: Sep. 2, 1997

[54] ONCE-THROUGH STEAM GENERATOR WITH A VERTICAL GAS FLUE OF ESSENTIALLY VERTICALLY DISPOSED TUBES

[75] Inventors: Wolfgang Kastner, Herzogenaurach; Wolfgang Köhler, Kalchreuth; Eberhard Wittchow, Erlangen, all of Germany

[73] Assignee: Siemens Aktiengesellschaft, Munich, Germany

[21] Appl. No.: 548,524

[22] Filed: Oct. 26, 1995

Related U.S. Application Data

[63] Continuation of Ser. No. 407,047, Mar. 17, 1995, abandoned, which is a continuation of Ser. No. 138,339, filed as PCT/DE91/00319, Apr. 18, 1991, abandoned.

[51] Int. Cl.[6] ..... F22B 37/00

[52] U.S. Cl. ..... 122/6 A

[58] Field of Search ..... 122/6 A, 235 A, 122/4 D

[56] References Cited

U.S. PATENT DOCUMENTS

| | | | |
|---|---|---|---|
| 4,825,813 | 5/1989 | Yoshinani et al. | 122/6 A |
| 4,987,862 | 1/1991 | Wittchow et al. | 122/6 A |
| 5,069,171 | 12/1991 | Hansen et al. | 122/4 D |
| 5,094,191 | 3/1992 | Garkawe et al. | 122/4 D |

FOREIGN PATENT DOCUMENTS

| | | |
|---|---|---|
| 1288755 | 2/1962 | France . |
| 3028240 | 2/1981 | Germany . |
| 2102105 | 1/1983 | United Kingdom . |

OTHER PUBLICATIONS

Babcock & Wilcox, I.P.C. F22B, pp. 1–4–1–5 "Steami Its Generation and Use".

*Primary Examiner*—Raymond A. Nelli

*Attorney, Agent, or Firm*—Herbert L. Lerner; Laurence A. Greenberg

[57] ABSTRACT

A once-through steam generator includes tubes together forming combustion chamber walls and carrying fossil fuel burners. The tubes are frequently provided on their inner surfaces with fins forming a multiple thread and are connected parallel to one another for conducting a coolant flow. According to the invention, the internal tube diameter is a function of a quotient, and points determined by pairs of values of the internal tube diameter and of the quotient lie in a coordinate system between a curve and a straight line. A summated mass throughput of all of the tubes at 100% steam output divided by the circumference of the gas flue in a horizontal section through the combustion chamber is used to form the quotient, and four defined points then lie on the curve which has a steady ascending slope. Application of this configuration is advantageously possible even for once-through steam generators having nominal outputs down to far below 500 MW.

8 Claims, 2 Drawing Sheets

ONCE-THROUGH STEAM GENERATOR WITH A VERTICAL GAS FLUE OF ESSENTIALLY VERTICALLY DISPOSED TUBES

CROSS-REFERENCE TO RELATED APPLICATION

This application is a continuation of application Ser. No. 08/407,047, filed Mar. 17, 1995, now abandoned, which is a continuation of application Ser. No. 08/138,339, filed on Oct. 18, 1993, now abandoned.

This application is a continuation of International Application Ser. No. PCT/DE91/00319, filed Apr. 18, 1991.

BACKGROUND OF THE INVENTION

1. Field of the Invention

The invention relates to once-through steam generators including a vertical gas flue formed of tubes being disposed essentially vertically, being welded gas-tightly to one another, together forming combustion chamber walls, carrying fossil fuel burners, having an internal tube diameter, having fins on their inner surfaces forming a multiple thread with a lead and a fin height and being connected in parallel for conducting a coolant flow.

Such once-through steam generators with vertical tubing of the combustion chamber walls are less expensive to manufacture than those having helical tubing and, in addition, have a lower pressure drop on the water/steam side. However, unavoidable differences in heat supply to the individual tubes, for example due to different degrees of slagging before and after sootblowing, can lead to temperature differences of up to 160° C. between individual tubes at an evaporator outlet (see Published European Application No. 0 217 079), causing damage due to inadmissible thermal stresses. Moreover, for reasons of tube cooling, it has heretofore been possible to construct such steam generators only for large unit outputs. In a publication entitled "Zwangdurchlaufkessel für Gleitdruckbetrieb mit vertikaler Brennkammerberohrung [Once-through Forced-flow Boilers for Variable-pressure Operation with Vertical Combustion Chamber Tubing]" by H. Juzie et al. in VGB KRAFTWERKSTECHNIK 64, No. 4, starting at page 292, a lower output limit of 500 MW is given for steam generators having a combustion chamber with vertical tubing and tangential bituminous coal firing.

That publication also shows that, in addition to the internal tube diameter, the mass flow density of the coolant in the tube is a parameter which determines the rheological structure of the parallel tube system acting as the evaporator heating surface. Typical mass flow densities are between 2000 and 3000 kg/m$^2$s for helical tubing of the combustion chamber with tubes that are smooth on the inside, and between 1500 and 2000 kg/m$^2$s for vertical tubing with internally finned tubes. With those construction parameters, the portion or share of the frictional pressure drop in the total pressure drop of the once-through evaporators is very high. Consequently, such evaporators have a typical characteristic, starting from the construction state, according to which the mass throughput in an individual tube decreases with more intensive heating thereof and increases with less intensive heating thereof.

That characteristic is one cause of major temperature differences between individual tubes at the evaporator outlet in gas flues having vertically disposed tubes. In order to reduce such temperature differences, it is known to incorporate restrictors at the evaporator inlet and/or to provide mixing headers, into which the tubes lead and in which a certain enthalpy equalization takes place by means of mixing, in the upper part of the combustion chamber walls outside the gas flue. At unit outputs below 500 MW, helical tubing for the combustion chamber walls has been provided in heretofore constructed once-through steam generators, in order to be able to maintain the mass flow density in the tubes necessary for cooling the smooth tubes and in order to achieve a certain equalization of heating along the large tube length. However, that measure causes higher manufacturing costs of the once-through steam generators and requires relatively high feed pump powers because of the high pressure drop which occurs.

SUMMARY OF THE INVENTION

It is accordingly an object of the invention to provide a once-through steam generator with a vertical gas flue of essentially vertically disposed tubes, which overcomes the hereinafore-mentioned disadvantages of the heretofore-known devices of this general type, in which it is possible to operate the once-through steam generator at advantageous costs and at the same time to reduce temperature differences at an evaporator outlet in an economical manner to permissible values and in which it is possible to extend the application limit for once-through steam generators with vertical tubing of combustion chamber walls to unit outputs significantly below 500 MW.

With the foregoing and other objects in view there is provided, in accordance with the invention, a once-through steam generator, comprising a vertical gas flue having a given circumference in a horizontal section and being formed of adjacent tubes having tube centers and being gas-tightly welded to one another for carrying fossil fuel burners; the tubes of the gas flue being connected in parallel for a coolant flow, being essentially vertically disposed, having an internal tube diameter d, having an inner surface, and having fins on the inner surface forming a multiple thread; the internal tube diameter d being a function of a quotient K; and points determined by pairs of values of the internal tube diameter d and of the quotient K being located in a coordinate system between a curve A having a steady ascending slope and a straight line B, the quotient K being formed of a summated mass throughput of all of the tubes at 100% steam output, divided by the given circumference, measured on lines connecting the tube centers of the adjacent tubes, the points corresponding to pairs of values $d_1$=12.5mm at $K_1$=3kg/s m, $d_2$=20.4mm at $K_2$=7kg/s m, $d_3$=30.6mm at $K_3$=13kg/s m and $d_4$=39.0mm at $K_4$=19kg/s m, lying on the curve A, and the points corresponding to pairs of values $d_5$=14.3mm at $K_5$=1.8kg/s m and $d_6$=38.4mm at $K_6$=7.6kg/s m, lying on the straight line B.

In accordance with another feature of the invention, the lead m of the fins forming a multiple thread on the inside of the tubes is at most equal to 0.9 times the square root of the internal tube diameter d in m and the fin height is at least 0.04 times the internal tube diameter d.

In accordance with a further feature of the invention, each of the internal tube diameters d associated with the quotient K deviates by at most 30% from the internal tube diameter d associated on the curve A with this quotient K.

In accordance with an added feature of the invention, the curves A and B are defined in such a way that the once-through steam generator can still be operated at a minimum load of 50% of full load or less in reliable once-through operation, without the advantages according to the invention being lost.

The structure of the once-through steam generator according to the invention is very advantageous because, as a result of the structure, the mass flow density in the flow-bearing tubes is lowered to such an extent and the internal tube diameter d is determined in such a way that the share of the geodetic pressure drop in the total pressure drop forces a change in the characteristic of once-through evaporators, starting from the construction state, according to which the mass throughput in an individual tube is increased with more intensive heating thereof and decreases with less intensive heating thereof. This novel characteristic leads to a marked evening-out of the steam temperatures and therefore of the tube wall temperatures at the outlet of the combustion chamber walls forming the evaporator heating surface.

The lowering of the mass flow density in the evaporator tubes has a further advantage because, with unchanged total mass throughput through the parallel tube system of the evaporator and with retention of the same internal tube diameters d, the number of tubes of the combustion chamber walls of the gas flue that are through-connected in parallel increases as compared with heretofore conventional structures. This makes it possible to increase the combustion chamber circumference/total mass throughput ratio and to extend the application limit for once-through steam generators with vertically tubed combustion chamber walls down into an output range far below 500 MW.

However, in order to ensure reliable cooling of the individual tubes in this case, they must be finned on the inside. The fin geometry must then be provided in such a way that water forced by the spinning of the coolant stream is always present on the inner tube wall almost throughout the evaporation area, and the danger of film evaporation has thus been eliminated.

In accordance with an additional feature of the invention, the the fossil fuel is coal or another solid fuel.

In accordance with yet another feature of the invention, the once-through steam generator is incorporated into a power station block having an electric power output of significantly less than 500 MW.

In accordance with a concomitant feature of the invention, a mass flow density in the tubes is at most in a range from about 800 to 850 kg/m$^2$s when the internal tube diameter d is up to 25 mm and is at most in a range from about 850 to about 950 kg/m$^2$s when the internal tube diameter is greater than 25 mm.

Other features which are considered as characteristic for the invention are set forth in the appended claims.

Although the invention is illustrated and described herein as embodied in a once-through steam generator with a vertical gas flue of essentially vertically disposed tubes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
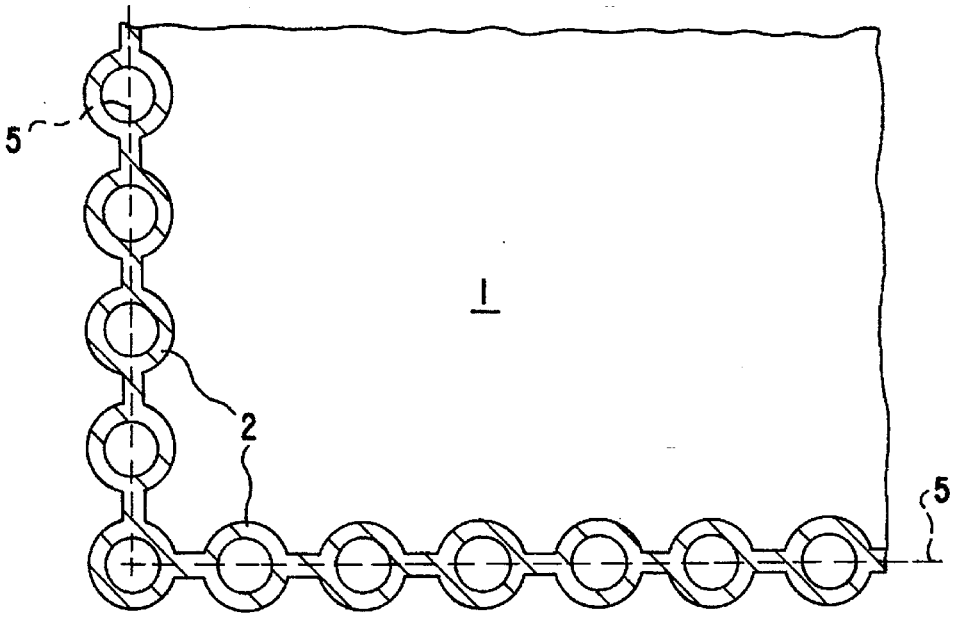
FIG. 1 is a fragmentary, diagrammatic, horizontal-sectional view of a vertical gas flue.

Referring now to the figures of the drawing in detail and first, particularly, to FIG. 1 thereof, there is seen a once-through steam generator having a vertical gas flue 1 that is surrounded by combustion chamber walls 2. The combustion chamber walls 2 are formed of tubes 3 seen in FIG. 2, which are disposed vertically and next to one another and which are welded gas-tightly to one another. For example, the tubes that are welded gas-tightly to one another may form a gas-tight combustion chamber wall 2 in a tube-web-tube structure or in a finned-tube structure.

Figure 2:
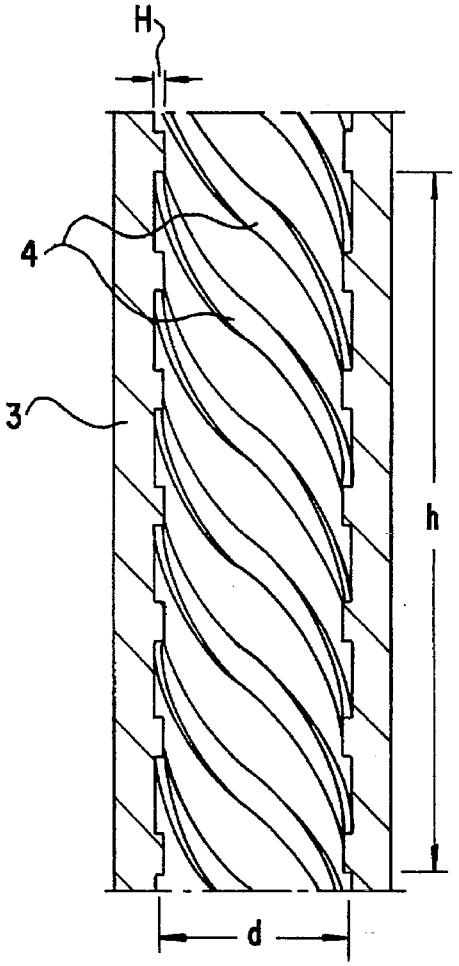
FIG. 2 is a longitudinal-sectional view of an individual tube.

According to FIG. 2, inner surfaces of the tubes 3 carry fins 4 which form a kind of multiple thread having a lead h and having a fin height H. An internal tube diameter d of the tubes 3 is defined by a calculated diameter of a circle which has the same surface area as the free cross-section of the tubes 3, constricted by the fins 4. The internal tube diameter d and the lead h are defined relative to one another by a function $h \leqq 0.9\sqrt{d}$, in order to initiate sufficient spinning of the coolant flow. Both h and d are measured in meters herein.

The combustion chamber walls 2 of the vertical gas flue 1 carry non-illustrated burners for fossil fuels which burn within the gas flue 1 and thus generate heat. The heat is absorbed by a coolant which flows through the tubes 3 forming the combustion chamber walls 2 and thus evaporates. In the normal case, the coolant being used is appropriately treated water. The fins 4 protrude by at least 0.04 times the internal tube diameter d into the tube 3, in order to guide the water fraction of the flowing coolant on the inside of the tube, since the spinning forces the water that is still present as a liquid at any time against the inside of a tube 3, above all even in the region in which the water evaporates, so that the tube 3 readily transmits the heat absorbed by it to the liquid and is thus reliably cooled.

In order to ensure that this occurs at all times to a sufficient extent, the internal tube diameter d is selected according to the invention to be not independent of a quotient K. The quotient K is defined herein by dividing a summated mass throughput M (kg/s) of all of the tubes 3 at 100% steam output by the circumference (m) of the gas flue 1. The circumference of the gas flue 1 is measured along a line 5, that is shown as a broken line in FIG. 1, which connects the tube centers of the individual adjacent tubes 3 to one another.

Figure 3:
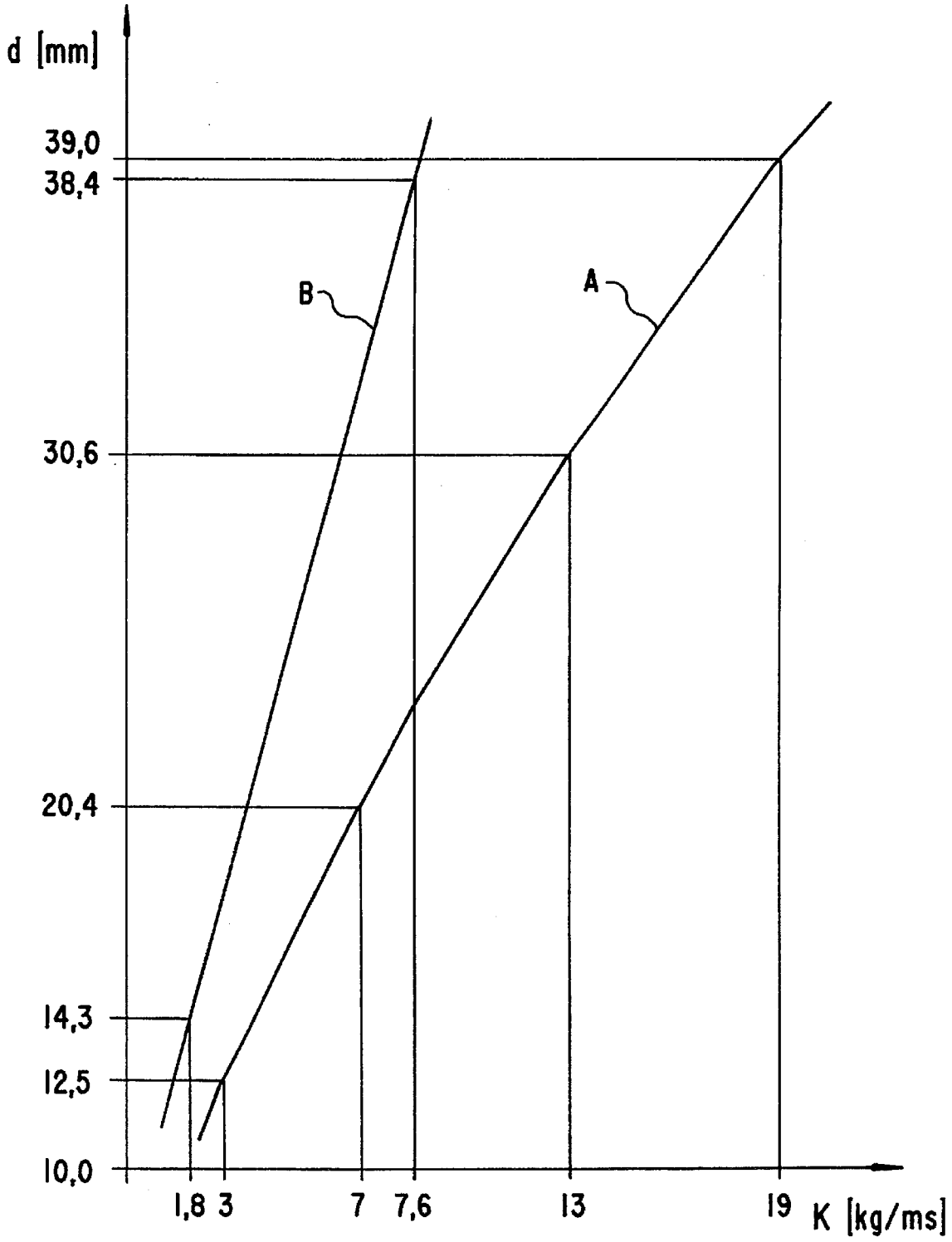
FIG. 3 is a diagram of a coordinate system with curves A and B.

The internal tube diameter d can be represented as a function of the quotient K in the coordinate system according to FIG. 3. Four points of a curve A are given by pairs of values:

$d_1$=12.5mm at $K_1$=3kg/s m, $d_2$=20.4mm at $K_2$=7kg/s m, $d_3$=30.6mm at $K_3$=13kg/s m and $d_4$=39.0mm at $K_4$=19kg/s m.

Each point in the field between this curve A and a straight line B represents a pair of values, at which portions or shares of a frictional pressure drop and a geodetic pressure drop are in such an advantageous mutual ratio, where in general, the geodetic pressure drop is then greater than the frictional pressure drop, that in the case of more intensive heating of an individual tube, the mass throughput through this tube increases.

At a predetermined quotient K, reliable cooling of the tubes therefore does not allow an arbitrary choice of the internal tube diameter d. For this reason, the field is limited to pairs of values, that usually occur in practice, by a straight line B which is defined by the points corresponding to pairs of values:

$d_5$=14.3mm at $K_5$=1.8kg/s m and $d_6$=38.4mm at $K_6$=7.6kg/s m.

According to the invention, the pairs of values formed from the internal tube diameter d and the quotient K thus lie between the curves A and B of the coordinate system according to FIG. 3.

Under particularly disadvantageous heating conditions, an internal tube diameter d associated with a quotient K should be at most 10% smaller or 30% greater than the internal tube diameter d associated on the curve A with this quotient K.

As a result of determining the magnitude of the internal tube diameter d in the manner indicated, the flow conditions in the tubes 3 are forced to be such that a share of the pressure drop caused by friction is in an advantageous ratio to the geodetically caused share of the pressure drop in the total pressure drop, in particular both at full load operation and at partial load operation down to a partial load of 50% of full load and less. As a consequence of the dimensions of the tubes 3 and of the gas flue 1, that are mutually matched according to the invention, these advantageous conditions are ensured by a relatively low flow velocity of the coolant, related to the mass of the coolant, in the axial direction with a simultaneous vigorous spinning motion thereof. This flow rate, expressed as the mass flow density, is at most about 800 and 850 kg/m$^2$s (curve A) at 100% steam output for the tubes up to an internal tube diameter d of 25 mm. At internal tube diameters d greater than 25 mm, the mass flow density increases a little and is then at most 850 and about 950 kg/m$^2$s (curve A).

The total pressure drop in the tubes 3, that is to say the difference between the pressure in the inlet header located at the bottom and the pressure in the outlet header located at the top, is composed of the portions or shares of the frictional pressure drop, the geodetic pressure drop and the acceleration pressure drop. The portion or share of the acceleration pressure drop amounts to 1 to 2% of the total pressure drop and can therefore be disregarded herein.

The frictional pressure drop of an individual tube 3 increases in the case of more intensive heating than in other tubes, due to the greater increase in volume of the water/steam mixture. Since the same pressure drop is predetermined for all of the parallel-connected tubes of an evaporator heating surface of a once-through steam generator, and since they are coupled to a common inlet header and a common outlet header, the throughput must decrease in the case of the more intensively heated tube in order to compensate for this pressure drop portion or share. In conjunction with the more intensive heating of the tube, this decreasing throughput consequently leads to greatly increased steam outlet temperatures at the tube end as compared with tubes with average heating or less intensive heating.

By contrast, the geodetic pressure drop of an individual tube 3 decreases in the case of more intensive heating of this tube as compared with other tubes, due to increased steam formation, because the weight of the water/steam column decreases. Due to this effect, the throughput through the more intensively heated tube therefore increases until the total of increased frictional pressure drop and decreased geodetic pressure drop reaches the pressure drop predetermined by the coupling through the inlet header and the outlet header. This increase in throughput is desired in order to keep the steam outlet temperature at the tube end low in spite of the more intensive heating. This influence of the geodetically caused pressure drop, that is comparatively large according to the invention, is the reason for the change in the characteristic of the once-through steam generator towards a behavior with which major temperature differences at the tube end of the evaporator are avoided, because more intensive heating of an individual tube is for the most part compensated by a higher coolant throughput through this tube.

These advantages of the invention manifest themselves particularly clearly in the case of once-through steam generators fired with solid fuel such as coal since, in that case, there is very wide more intensive or less intensive heating of individual tubes due to the different fouling of the combustion chamber walls.

We claim:

1. A once-through steam generator, comprising:

a vertical gas flue having a given circumference in a horizontal section and being formed of adjacent tubes having tube centers and being gas-tightly welded to one another, and said gas flue being associated with fossil fuel burners, said given circumference being measured on lines connecting said tube centers of said adjacent tubes;

said tubes of said gas flue being connected in parallel for a coolant flow, being essentially vertically disposed, having an internal tube diameter d, having an inner surface, and having fins on said inner surface forming a multiple thread;

said internal tube diameter d being a function of a quotient K, wherein:

said quotient K is defined as a summed mass throughput of all of said tubes at 100% steam output, divided by said given circumference; and when said quotient K, expressed in kg/s m, is from 3 to 7, said tube diameter d, expressed in mm, is from 1.975K+6.575 to 5.15K+6.82;

when said quotient K is from 7 to 13, said tube diameter d is from 1.74K+8.50 to 4.15K+6.82; and when said quotient K is from 13 to 19, said tube diameter d is from 1.40K+12.4 to 4.15K+6.82.

2. The once-through steam generator according to claim 1 wherein a lead of said fins in said tubes, as measured in meters, is at most equal to 0.9 times the square root of said internal tube diameter d, as measured in meters, and a height of said fins forming said thread is at least equal to 0.04 times said internal tube diameter d.

3. The once-through steam generator according to claim 1, wherein/including said internal tube diameter d associated with said quotient K is at most 10% smaller and at most 30% greater than said internal tube diameter d associated with said quotient K on said curve A.

4. The once-through steam generator according to claim 1, wherein a minimum load in once-through operation is ≦50% of full load.

5. The once-through steam generator according to claim 1, wherein the fossil fuel is coal.

6. The once-through steam generator according to claim 1, wherein the fossil fuel is a solid fuel.

7. The once-through steam generator according to claim 1, wherein the once-through steam generator is incorporated into a power station block having an electric power output of significantly less than 500 MW.

8. The once-through steam generator according to claim 1, wherein a mass flow density in said tubes is at most in a range from about 800 to 850 $kg/m^2s$ when said internal tube diameter d is up to 25 mm and is at most in a range from about 850 to about 950 $kg/m^2s$ when said internal tube diameter is greater than 25 mm.

* * * * *